US012791025B1

(12) United States Patent
Picouet et al.

(10) Patent No.: US 12,791,025 B1
(45) Date of Patent: Nov. 10, 2026

(54) SINGLE SCREW COMPRESSOR GATE ROTOR BEARINGS ARRANGEMENT FOR OILLESS PROCESS SYSTEM APPLICATIONS

(71) Applicant: COPELAND INDUSTRIAL LP, St. Louis, MO (US)

(72) Inventors: Jean-Louis Picouet, Waukesha, WI (US); Abhijit Narayanrao Pande, Pune (IN); Pallavi Vishal Narkhede, Pune (IN)

(73) Assignee: Copeland Industrial LP, St. Louis, MO (US)

( * ) Notice: Subject to any disclaimer, the term of this patent is extended or adjusted under 35 U.S.C. 154(b) by 0 days.

(21) Appl. No.: 19/429,418

(22) Filed: Dec. 22, 2025

(51) Int. Cl.
*F04C 29/02* (2006.01)
*F04C 18/16* (2006.01)

(52) U.S. Cl.
CPC ..... *F04C 29/02* (2013.01); *F04C 18/16* (2013.01); *F04C 2240/50* (2013.01)

(58) Field of Classification Search
CPC ..... F04C 29/023; F04C 18/52; F04C 18/084; F04C 29/0021; F04C 18/16; F04C 2240/52; F04C 28/12; F04C 28/125; F04C 29/02; F04C 2230/10; F04C 2270/17; F04C 27/009; F04C 18/08; F04C 18/086; F04C 18/1075; F04C 18/56; F04C 2230/60; F04C 2230/91; F04C 2240/603; F04C 2240/81; F04C 2250/20; F04C 2250/201; F04C 2270/044; F04C 2270/12; F04C 2270/13; F04C 23/001; F04C 27/004; F04C 27/007; F04C 28/10; F04C 28/24; F04C 29/0007; F04C 29/0035; F04C 29/06; F04C 29/12; F04C 29/124; F04C 3/02; F04C 2240/30
USPC ..... 418/195, 196, 125, 46, 97, 201.1, 55.6
See application file for complete search history.

(56) References Cited

U.S. PATENT DOCUMENTS 4,227,867 A * 10/1980 Whitehill ..... F04C 18/52 418/196
4,492,542 A * 1/1985 Zimmern ..... F01C 3/025 418/196
4,880,367 A 11/1989 Bein
4,890,989 A 1/1990 Zimmern
4,941,811 A 7/1990 Winyard
5,018,952 A 5/1991 Winyard
5,080,568 A 1/1992 Zimmern
(Continued)

*Primary Examiner* — Mark A Laurenzi
*Assistant Examiner* — Benjamin Doyle
(74) *Attorney, Agent, or Firm* — Amundsen Davis, LLC

(57) ABSTRACT

Screw compressors and methods of assembling and operating screw compressors are disclosed in which lubricant may be provided to the bearings in the bearing assembly securing the gate rotor shaft in a manner that prevents the lubricant from entering the process gas area of the compressor. Compressors include a gate rotor having a gate rotor shaft that extends longitudinally in a single direction from the gate rotor support. The gate rotor is rotationally mounted within a gate rotor chamber of the compressor housing by a bearing assembly. The gate rotor shaft extends into and is rotationally mounted within the bearing assembly, and the bearing assembly includes a bearing that surrounds a portion of the gate rotor shaft, and a lubricant passage that has a lubricant inlet and a lubricant outlet. The lubricant passage is configured to provide lubricant to the bearing.

19 Claims, 4 Drawing Sheets

(56) References Cited

U.S. PATENT DOCUMENTS

| | | | | |
|---|---|---|---|---|
| 5,082,431 | A | 1/1992 | Bein | |
| 6,398,532 | B1 | 6/2002 | Zha et al. | |
| 8,992,195 | B2 | 3/2015 | Hossain et al. | |
| 2010/0158737 | A1* | 6/2010 | Gotou | F04C 27/00 418/125 |
| 2010/0278677 | A1* | 11/2010 | Hossain | F01C 17/02 418/195 |
| 2010/0278678 | A1* | 11/2010 | Gotou | F01C 17/02 418/195 |
| 2010/0329918 | A1* | 12/2010 | Gotou | F04C 29/042 418/195 |
| 2012/0003113 | A1* | 1/2012 | Shikano | F04C 29/0014 418/195 |
| 2020/0003212 | A1* | 1/2020 | Ueno | F04C 18/52 |
| 2020/0032800 | A1* | 1/2020 | Fujiwara | F04C 18/52 |
| 2023/0015175 | A1* | 1/2023 | Fukuda | F04C 2/16 |

* cited by examiner

(Prior Art)

SINGLE SCREW COMPRESSOR GATE ROTOR BEARINGS ARRANGEMENT FOR OILLESS PROCESS SYSTEM APPLICATIONS

FIELD OF THE INVENTION

The present technology relates to compressor systems, and more particularly to gate rotor bearing arrangements for compressors used in applications having oilless gas process areas.

BACKGROUND

Compressors, for example single screw compressors, are used in many applications. One type of rotary gas compressor employs a housing that contains a motor-driven single main rotor.

The main rotor has helical grooves that define gas compression chambers, also known as the process area. Two gate rotors are located 1800 from each other, one on each side of the main rotor, and each has teeth that mesh with the gas compression chambers of the main rotor, closing the gas compression chambers off during each compression cycle.

For example, FIG. 1 is an exploded view of a known single screw compressor 100. As shown in FIG. 1, the compressor 100 has a main rotor 102, which has a cylindrical outer surface 104 that is helically grooved and a rotor shaft 106. The rotor shaft 106 extends axially along, and rotates about, a schematic central axis A. Compressor 100 also includes a compressor housing 108, and the main rotor 102 is mounted for rotation about the rotor shaft 106 within the compressor housing 108. The compressor housing 108 generally defines a cylindrical bore 114 in which the main rotor is rotatably mounted. The cylindrical bore 114 may be open at its suction end 116 and may be closed at its discharge end 118 by a discharge end wall (not shown). The main rotor 102 includes at least one helical groove 120, and as shown includes a plurality of helical grooves 120. Each helical groove 120 of the main rotor 102 defines a compression chamber 128.

As shown in FIG. 1, the compressor 100 may also include at least one, and generally two, dual slide valve assemblies 126, which are mounted inside the compressor housing 108 and cooperate with the main rotor 102 to control gas flow into and from the compression chambers 128 formed by the helical grooves 120 on the main rotor 102.

The compressor 100 also includes two gate rotors 110, which are also mounted for rotation in the compressor housing 108. Generally, each of the gate rotors is oriented transversely (perpendicularly) to the schematic axis A of the main rotor 102. The first gate rotor 110 is rotationally mounted within the compressor housing 108 on a first side of the main rotor 102, in a first gate rotor chamber 122, and the second gate rotor 110 is rotationally mounted within the compressor housing 108 on a second side of the main rotor 102 that is opposite the first side, in a second gate rotor chamber 122.

Each gate rotor 110 may include a gate rotor blade 130, which includes one or more gate rotor teeth 112. Each gate rotor blade 130 is mounted on a gate rotor support 132 that is attached to, and as shown is integrated as one piece with, a gate rotor shaft 124. Each gate rotor shaft 124 extends vertically outwardly from the gate rotor support 132 in two directions (i.e., upwardly and downwardly). Each gate rotor shaft 124 is rotatably mounted to the compressor housing 108 by two bearing assemblies at opposite ends of the gate rotor shaft 124, one bearing assembly securing the upper end of the gate rotor shaft 124 and one bearing assembly securing the lower end of the gate rotor shaft 124.

During operation of single screw compressors, such as compressor 100, various areas of the compressors need lubrication and cooling in order to avoid overheating. The lubrication and cooling media is typically oil. However, in some applications, the compressed gas must be oilless (i.e., free of oil), which means that it is important to prevent oil from entering the process area.

SUMMARY

Disclosed herein are screw compressors and methods of assembling and operating screw compressors.

In a first aspect, a screw compressor is provided. The screw compressor includes a compressor housing, a main rotor, a first gate rotor. The compressor housing defines a cylindrical bore and a first gate rotor chamber. The main rotor is rotationally mounted within the cylindrical bore of the compressor housing, the main rotor including at least one helical groove that defines a compression chamber. The first gate rotor is rotationally mounted within the first gate rotor chamber of the compressor housing by a first bearing assembly. The first gate rotor includes a first gate rotor blade secured to a first gate rotor support and having a first gate rotor shaft that extends longitudinally in a single direction from the first gate rotor support. The first gate rotor shaft extends into and is rotationally mounted within the first bearing assembly, and the first bearing assembly includes a first bearing that surrounds a first portion of the gate rotor shaft, a first lubricant passage having a first lubricant inlet and a first lubricant outlet, the first lubricant passage being configured to provide lubricant to the first bearing.

In a second aspect, a method of assembling and operating a screw compressor is provided, wherein the screw compressor includes: a compressor housing that defines a cylindrical bore and a first gate rotor chamber; and a main rotor rotationally mounted within the cylindrical bore of the compressor housing, the main rotor including at least one helical groove that defines a compression chamber. The method includes rotationally mounting a first gate rotor within the first gate rotor chamber of the compressor housing by a first bearing assembly, wherein the first gate rotor includes a first gate rotor blade secured to a first gate rotor support and has a first gate rotor shaft that extends longitudinally in a single direction from the first gate rotor support, and the first bearing assembly includes a first bearing that surrounds a first portion of the gate rotor shaft, a first lubricant passage having a first lubricant inlet and a first lubricant outlet, the first lubricant passage being configured to provide lubricant to the first bearing. The rotationally mounting includes: inserting a portion of the first gate rotor shaft into the first bearing assembly and rotationally mounting the first gate rotor shaft within the first bearing assembly; and securing the first bearing assembly to the compressor housing.

BRIEF DESCRIPTION OF THE DRAWINGS

Specific examples have been chosen for purposes of illustration and description, and are shown in the accompanying drawings, forming a part of the specification.

Figure 1:
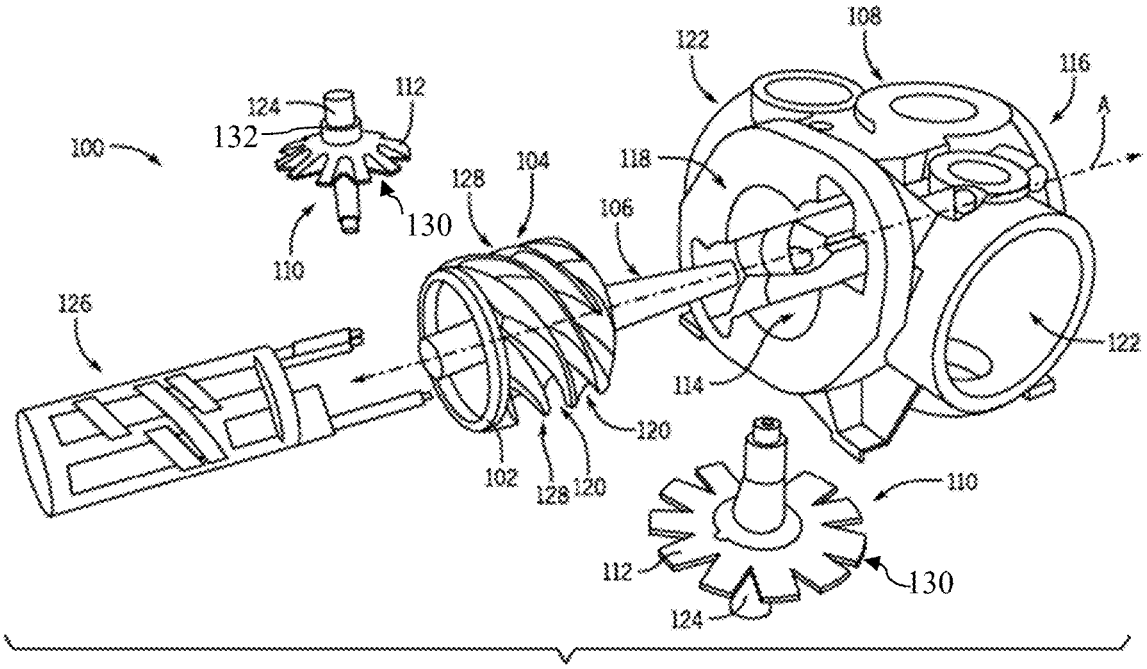
FIG. 1 illustrates an exploded view of a prior art single screw compressor.

While various embodiments discussed herein are amenable to modifications and alternative forms, aspects thereof have been shown by way of example in the drawings and are described in detail herein. It should be understood, however, that the disclosure is not limited to the particular embodiments described, and instead is meant to include all modifications, equivalents, and alternatives falling within the scope of the disclosure. In addition, the terms "example" and "embodiment" as used throughout this application is only by way of illustration, and not limitation. The term "about" with respect to a value or measurement as used herein means the stated value or measurement plus or minus a 10% margin of error. The term "configured to" as used herein with respect to a component being "configured to" have certain structural characteristics in specified circumstances or to perform a function means that the component is structurally formed such that the component meets the structural characteristics in the specified circumstances or performs the function without further modification. Directional terms, such as vertically, upward, upwardly, above, below, lower, downward and downwardly are relative terms used in reference to the orientation shown in the relevant figure. The Figures are not necessarily drawn to scale. The use of the same reference symbols in different drawings indicates similar or identical items unless otherwise noted.

DETAILED DESCRIPTION

Generally, the present technology provides single screw compressors and methods of assembling and operating single screw compressors that allow for lubricant, such as oil, to be provided to the bearings in the bearing assembly securing the gate rotor shaft in a manner that prevents the lubricant from entering the process gas area of the compressor. Such compressors may be particularly useful in applications where the compressed gas must be oilless.

Figure 2:
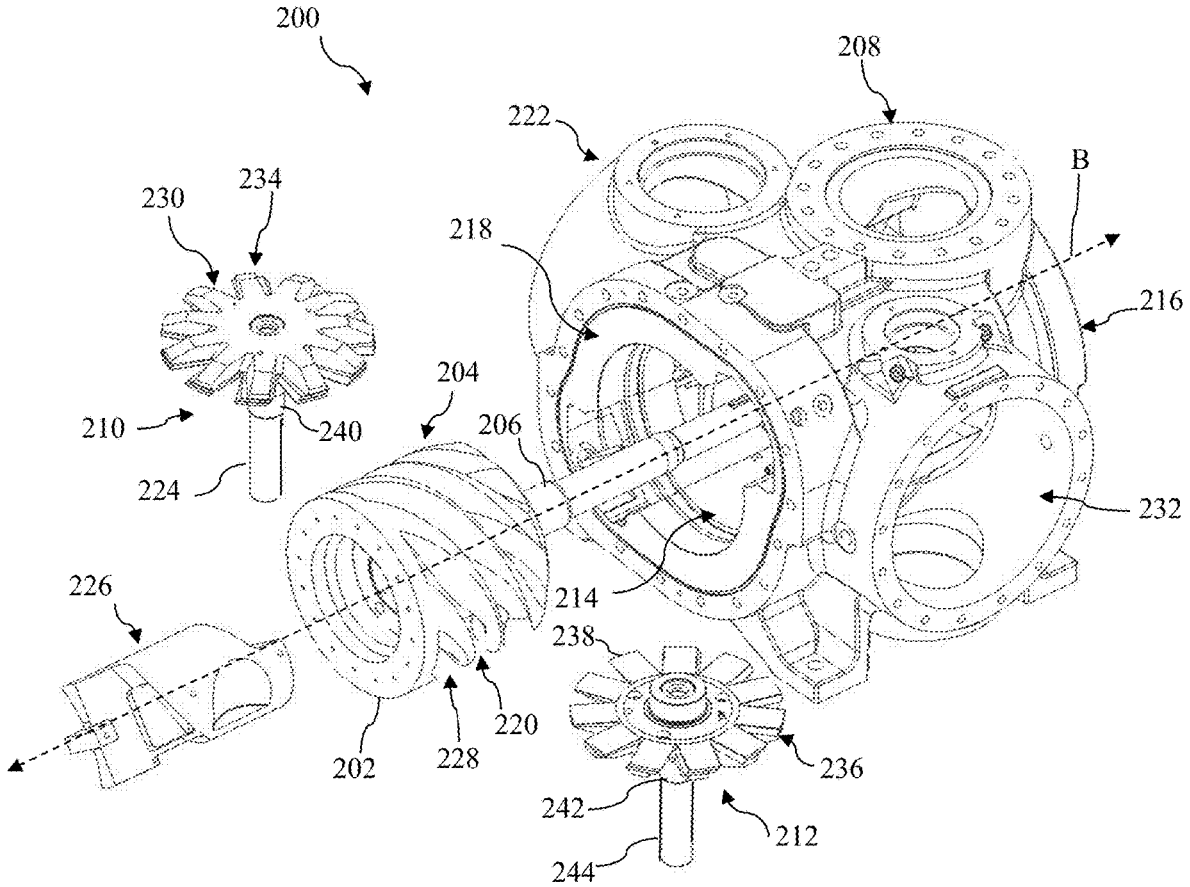
FIG. 2 illustrates an exploded view of a single screw compressor of the present technology.
Figure 3:
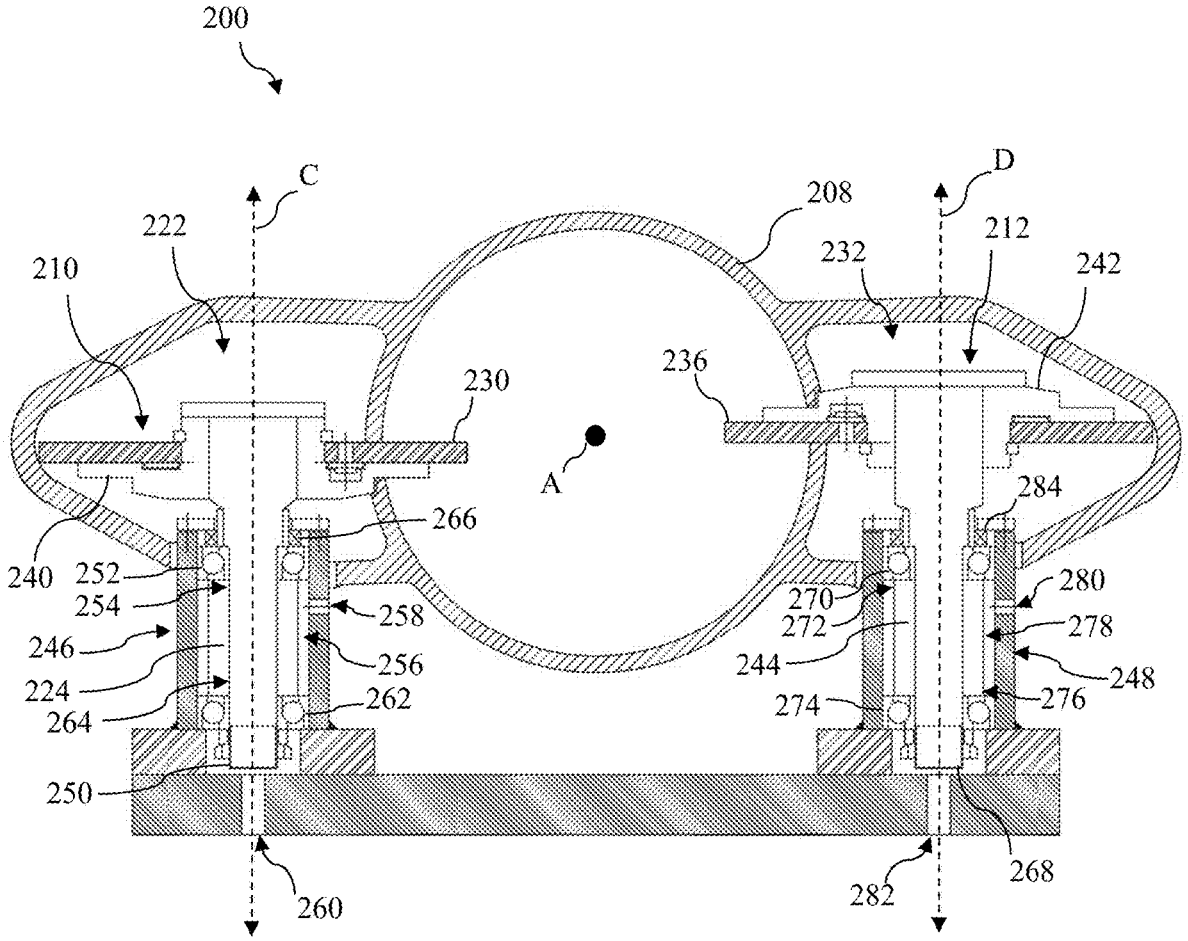
FIG. 3 is a cross-sectional front view of the single screw compressor of FIG. 2, with the main rotor not shown.

FIGS. 2 and 3 illustrate one example of a compressor 200 of the present technology. In the illustrated example, the compressor 200 is a rotary gas compressor, and is specifically a single screw rotary gas compressor.

As shown in FIG. 2, the compressor 200 has a main rotor 202, which has a cylindrical outer surface 204 that is helically grooved and a rotor shaft 206. The rotor shaft 206 extends axially along a schematic central axis B. Compressor 200 also includes a compressor housing 208, and the main rotor 202 is mounted for rotation about the rotor shaft 206 within the compressor housing 208. The compressor housing 208 generally defines a cylindrical bore 214, and the main rotor is rotationally mounted within the cylindrical bore 214 of the compressor housing 208. The cylindrical bore 214 may be open at its suction end 216 and may be closed at its discharge end 218 by a discharge end wall (not shown). The rotor shaft 206 of the main rotor 202 is rotatably supported at opposite ends on bearing assemblies (not shown) mounted on compressor housing 208. The main rotor 202 includes at least one helical groove 220, and as shown includes a plurality of helical grooves 220. Each helical groove 220 of the main rotor 202 defines a compression chamber 228.

As shown in FIG. 2, the compressor 200 may also include at least one, and generally two, dual slide valve assemblies 226, which are mounted inside the compressor housing 208 and cooperate with the main rotor 202 to control gas flow into and from the compression chambers 228 formed by the helical grooves 220 on the main rotor 202.

Referring to FIGS. 2 and 3, the compressor 200 also includes at least a first gate rotor 210, which is also mounted for rotation in the compressor housing 208. Accordingly, the compressor housing 208 defines at least a first gate rotor chamber 222 therein, in which the first gate rotor 210 is rotatably mounted. In the illustrated embodiment, the compressor 200 includes two gate rotors, first gate rotor 210 and second gate rotor 212. Thus, the compressor housing 208 defines two gate rotor chambers, first gate rotor chamber 222 and second gate rotor chamber 232. The first gate rotor 210 is rotationally mounted within the compressor housing 208 on a first side of the main rotor 202 and the second gate rotor 212 is rotationally mounted within the compressor housing 208 on a second side of the main rotor 202 that is opposite the first side. Accordingly, the gate rotors 210 and 212 are located on opposite sides (i.e., 180 degrees apart) of main rotor 202.

Referring to FIG. 2, each gate rotor may include a gate rotor blade, which includes one or more gate rotor teeth. As shown, first gate rotor 210 includes a first gate rotor blade 230, which includes one or more gate rotor teeth 234. Similarly, second gate rotor 212 includes a second gate rotor blade 236, which includes one or more gate rotor teeth 238.

Referring to FIGS. 2 and 3, each gate rotor blade may be mounted on a gate rotor support that is attached to a gate rotor shaft. As shown, the first gate rotor blade 230 is mounted on a first gate rotor support 240 that is attached to a first gate rotor shaft 224. Similarly, the second gate rotor blade 236 is mounted on a second gate rotor support 242 that is attached to a second gate rotor shaft 244. Each gate rotor shaft extends vertically outwardly from the gate rotor support in a single direction (as shown, downwardly). Accordingly, as shown, first gate rotor shaft 224 extends vertically outwardly from the first gate rotor support 240 in a downward direction, and does not also extend vertically upwardly from the first gate rotor support 240. Similarly, second gate rotor shaft 244 extends vertically outwardly from the second gate rotor support 242 in a downward direction, and does not also extend vertically upwardly from the second gate rotor support 242.

Referring to FIG. 3, each of the gate rotors 210 extends longitudinally along, and rotates about, a schematic central axis (shown as schematic central axis C for the first gate rotor 210 and schematic central axis D for the second gate rotor 210) that is transverse (perpendicular) to and spaced from the schematic central axis A of main rotor 102 (i.e., the axis of rotation of the main rotor 102).

Each of the gate rotors 210 is rotationally mounted within its respective gate rotor chamber 222 of the compressor housing 208 by one bearing assembly. As shown, the first gate rotor 210 is rotationally mounted within the first gate rotor chamber 222 of the compressor housing 208 by a first bearing assembly 246, and the second gate rotor 212 is rotationally mounted within the second gate rotor chamber 232 of the compressor housing 208 by a second bearing assembly 248.

With respect to the first gate rotor 210, the first gate rotor 210 includes the first gate rotor blade 230 that is secured to the first gate rotor support 240. The first gate rotor shaft 224 extends longitudinally in a single direction from the first gate rotor support 240. More specifically, the first gate rotor shaft 224 extends longitudinally downwardly from the first gate rotor support. The first gate rotor shaft 224 has a first length that extends from the first gate rotor support 240 downwardly to the first gate rotor shaft base 250. The first gate rotor shaft 224 extends into and is rotationally mounted within the first bearing assembly 246. The first bearing assembly 246 is the only bearing assembly by which the first gate rotor 210 is rotationally mounted within the first gate rotor chamber 222 of the compressor housing 208.

The first bearing assembly 246 includes a first bearing 252 that surrounds a first portion 254 of the gate rotor shaft 224. In the illustrated example, the first portion 254 of the first gate rotor shaft 224 that is surrounded by the first bearing 252 is located on an upper half of the first length of the first gate rotor shaft 224.

The first bearing assembly 246 may also include a second bearing 262 that surrounds a second portion 264 of the gate rotor shaft 224. In the illustrated example, the second portion 264 of the first gate rotor shaft 224 that is surrounded by the second bearing 262 is located on an lower half of the first length of the first gate rotor shaft 224.

The first bearing assembly 246 also includes a first lubricant passage 256 having a first lubricant inlet 258 and a first lubricant outlet 260. The first lubricant inlet 258 may be located below the first bearing 252. The first lubricant passage is configured to provide lubricant to the first bearing 252 and the second bearing 262. The first lubricant outlet 260 is located below the first lubricant inlet 256, and may also be below the second bearing 262, and lubricant injected into the first lubricant passage 256 through the first lubricant inlet 258 may flow by gravity downwardly through the first lubricant passage 258 to the first lubricant outlet 260. Accordingly, during operation of the compressor 200, lubricant, such as oil, may be injected into the first lubricant passage 256 through the first lubricant inlet 258 to lubricate the first bearing 252 and the second bearing 262, and then the lubricant may be drawn downwardly by gravity to exit the first lubricant passage 256 through the first lubricant outlet 260. The lubricant may then be directed to a collection reservoir, such as an oil sump (not shown).

The first bearing assembly 246 may further include a first seal 266, which may be located above the first bearing 252. The first seal 266 may be configured to prevent lubricant from entering the first gate rotor chamber 222.

With respect to the second gate rotor 212, the second gate rotor 212 includes the second gate rotor blade 236 that is secured to the second gate rotor support 242. The second gate rotor shaft 244 extends longitudinally in a single direction from the second gate rotor support 242. More specifically, the second gate rotor shaft 244 extends longitudinally downwardly from the second gate rotor support 242. The second gate rotor shaft 244 has a second length that extends from the second gate rotor support 242 downwardly to the second gate rotor shaft base 268. The second gate rotor shaft 244 extends into and is rotationally mounted within the second bearing assembly 248. The second bearing assembly 248 is the only bearing assembly by which the second gate rotor 212 is rotationally mounted within the second gate rotor chamber 232 of the compressor housing 208.

The second bearing assembly 248 includes a third bearing 270 that surrounds a first portion 272 of the second gate rotor shaft 244. In the illustrated example, the first portion 272 of the second gate rotor shaft 244 that is surrounded by the third bearing 270 is located on an upper half of the second length of the second gate rotor shaft 244.

The second bearing assembly 248 may also include a fourth bearing 274 that surrounds a second portion 276 of the second gate rotor shaft 244. In the illustrated example, the second portion 276 of the second gate rotor shaft 244 that is surrounded by the fourth bearing 274 is located on a lower half of the first length of the first gate rotor shaft 244.

The second bearing assembly 248 also includes a second lubricant passage 278 having a second lubricant inlet 280 and a second lubricant outlet 282. The second lubricant inlet 280 may be located below the third bearing 270. The lubricant may then be directed to a collection reservoir, such as an oil sump (not shown) lubricant passage 278 is configured to provide lubricant to the third bearing 270 and the fourth bearing 274. The second lubricant outlet 282 is located below the second lubricant inlet 280, and may also be below the fourth bearing 274, and lubricant injected into the second lubricant passage 278 through the first lubricant inlet 280 may flow by gravity downwardly through the second lubricant passage 278 to the second lubricant outlet 282. Accordingly, during operation of the compressor 200, lubricant, such as oil, may be injected into the second lubricant passage 278 through the second lubricant inlet 280 to lubricate the third bearing 270 and the fourth bearing 274, and then the lubricant may be drawn downwardly by gravity to exit the second lubricant passage 278 through the second lubricant outlet 282. The lubricant may then be directed to a collection reservoir, such as an oil sump (not shown).

The second bearing assembly 248 may further include a second seal 284, which may be located above the third bearing 270. The second seal 284 may be configured to prevent lubricant from entering the second gate rotor chamber 232.

Figure 4:
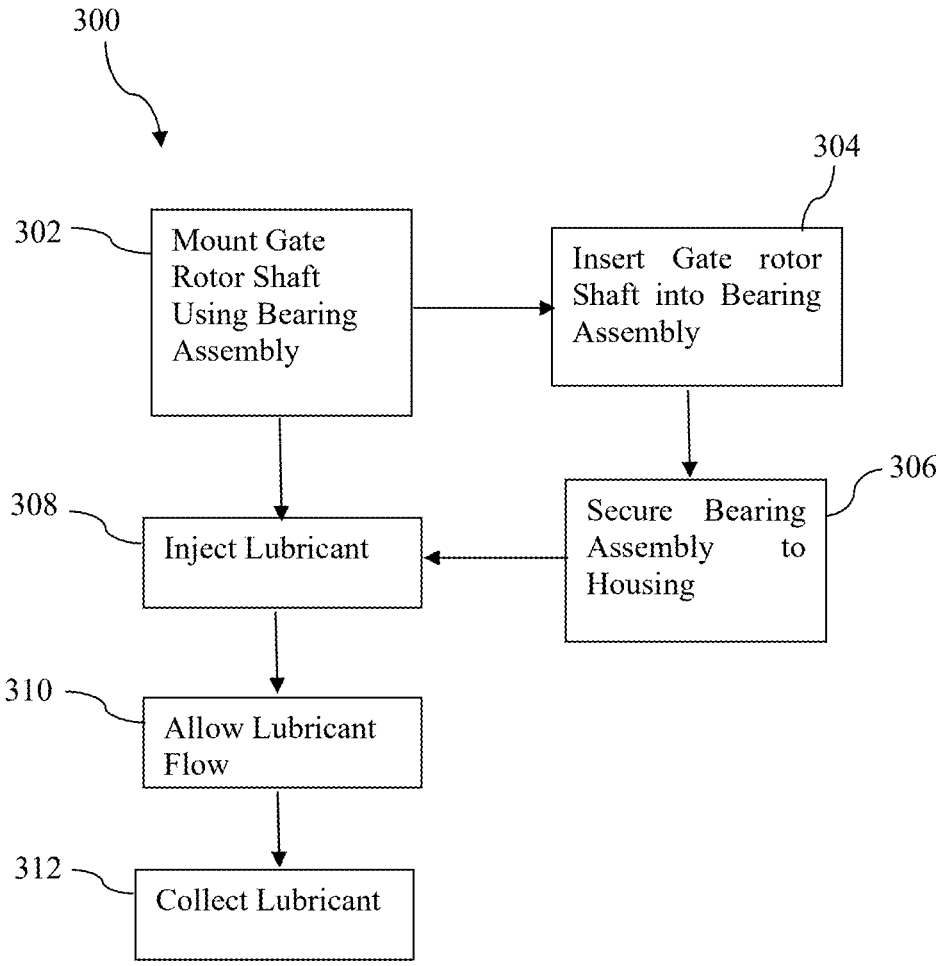
FIG. 4 is flow chart illustrating a method of assembling and operating a screw compressor of the present technology.

FIG. 4 illustrates one example of a method 300 of assembling and operating a screw compressor of the present technology, such as compressor 200. As described above with reference to FIGS. 2 and 3, the screw compressor 200 includes a compressor housing 208 that defines a cylindrical bore 214 and a first gate rotor chamber 222. The compressor 200 also includes a main rotor 202 rotationally mounted within the cylindrical bore 214 of the compressor housing 208. The main rotor 202 includes at least one helical groove 220 that defines a compression chamber 228.

The method 300 for use with such a compressor starts at step 302, which includes rotationally mounting a first gate rotor within the first gate rotor chamber of the compressor housing by a first bearing assembly. In this step 302, first gate rotor may include a first gate rotor blade secured to a first gate rotor support and has a first gate rotor shaft that extends longitudinally in a single direction from the first gate rotor support. Additionally, the first bearing assembly may include a first bearing that surrounds a first portion of the gate rotor shaft, a first lubricant passage having a first lubricant inlet and a first lubricant outlet, and the first lubricant passage may be configured to provide lubricant to the first bearing. With reference to FIGS. 2 and 3, step 302 of the method may include rotationally mounting the first gate rotor 210 within the first gate rotor chamber 222 of the compressor housing 208 by the first bearing assembly 246; wherein the first gate rotor 210 includes the first gate rotor blade 230 secured to the first gate rotor support 240 and has a first gate rotor shaft 224 that extends longitudinally in a single direction from the first gate rotor support 240, and the first bearing assembly 246 includes the first bearing 252 that surrounds the first portion 254 of the first gate rotor shaft 224, a first lubricant passage 256 having the first lubricant inlet 258 and the first lubricant outlet 260, and the first lubricant passage 256 may be configured to provide lubricant to the first bearing 252.

The rotationally mounting of step 302 may include step 304, which includes inserting a portion of the first gate rotor shaft into the first bearing assembly and rotationally mounting the first gate rotor shaft within the first bearing assembly. With reference to FIGS. 2 and 3, step 304 of the method may include inserting a portion of the first gate rotor shaft 224 into the first bearing assembly 246 and rotationally mounting the first gate rotor shaft 224 within the first bearing assembly 246.

The rotationally mounting of step 302 may also include step 306, which includes securing the first bearing assembly to the compressor housing. With reference to FIGS. 2 and 3, step 306 of the method may include securing the first bearing assembly 246 to the compressor housing 208. One or more fasteners, such as bolts or screws, may be used to secure the first bearing assembly 246 to the compressor housing 208.

When the single screw compressor includes a second gate rotor, such as compressor 200 that includes second gate rotor 212, steps similar to steps 302, 204 and 306 may be used to rotationally mount the second gate rotor within the second gate rotor chamber of the compressor housing by the second bearing assembly.

The method 300 may also include step 308, which includes injecting lubricant into the first lubricant inlet during operation of the screw compressor. With reference to FIGS. 2 and 3, step 308 of the method may include injecting lubricant into the first lubricant inlet 258 during operation of the screw compressor 200.

The method 300 may also include step 310, which includes allowing the lubricant to flow by gravity through the first lubricant passage. With reference to FIGS. 2 and 3, step 310 of the method may include allowing the lubricant to flow by gravity through the first lubricant passage 256.

The method 300 may also include step 312, which includes collecting lubricant that exits the first lubricant passage through the first lubricant outlet. With reference to FIGS. 2 and 3, step 312 of the method may include collecting lubricant that exits the first lubricant passage 256 through the first lubricant outlet 260.

When the single screw compressor includes a second gate rotor secured by a second bearing assembly having a second lubricant passage, such as compressor 200 that includes second gate rotor 212 secured by the second bearing assembly 248 having the second lubricant passage 278, steps similar to steps 308, 310, and 312 may be used to provide lubricant to the bearings during operation of the compressor.

In accordance with the discussion of the illustrated embodiments above, it should be understood that a screw compressor of the present technology may include: a compressor housing that defines a cylindrical bore and a first gate rotor chamber; a main rotor rotationally mounted within the cylindrical bore of the compressor housing, the main rotor including at least one helical groove that defines a compression chamber; and a first gate rotor rotationally mounted within the first gate rotor chamber of the compressor housing by a first bearing assembly, the first gate rotor including a first gate rotor blade secured to a first gate rotor support and having a first gate rotor shaft that extends longitudinally in a single direction from the first gate rotor support; wherein the first gate rotor shaft extends into and is rotationally mounted within the first bearing assembly, and the first bearing assembly includes a first bearing trat surrounds a first portion of the gate rotor shaft, a first lubricant passage having a first lubricant inlet and a first lubricant outlet, the first lubricant passage being configured to provide lubricant to the first bearing.

Such a screw compressor may include one or more of the following additional features. The first gate rotor shaft may extend longitudinally downwardly from the first gate rotor support. The first bearing assembly may be the only bearing assembly by which the first gate rotor is rotationally mounted within the first gate rotor chamber of the compressor housing. The first gate rotor shaft may have a first length that extends from the first gate rotor support downwardly to a first gate rotor shaft base, and the first portion of the first gate rotor shaft that is surrounded by the first bearing may be located on an upper half of the first length of the first gate rotor shaft. The first bearing assembly may include a first seal located above the first bearing, the first seal being configured to prevent lubricant from entering the first gate rotor chamber. The first bearing assembly may further include a second bearing that surrounds a second portion of the first gate rotor shaft, and the first lubricant passage is configured to provide lubricant to both the first bearing and the second bearing. The second portion of the first gate rotor shaft that is surrounded by the second bearing may be located on a lower half of the first length of the first gate rotor shaft. The first lubricant inlet may be located below the first bearing. The first lubricant outlet may be located below the first lubricant inlet and lubricant injected into the first lubricant passage through the first lubricant inlet may flow by gravity downwardly through the first lubricant passage to the first lubricant outlet.

Such a screw compressor may further include a second gate rotor rotationally secured within the compressor housing by a second bearing assembly. Accordingly, the compressor housing further defines a second gate rotor chamber, and the screw compressor further comprises: a second gate rotor rotationally mounted within the second gate rotor chamber of the compressor housing by a second bearing assembly, the second gate rotor including a second gate rotor blade secured to secured to a second gate rotor support and having a second gate rotor shaft that extends longitudinally in a single direction from the second gate rotor support; wherein the second gate rotor shaft extends into and is rotationally mounted within the second bearing assembly, and the second bearing assembly includes a third bearing that surrounds a first portion of the second gate rotor shaft, a second lubricant passage having a second lubricant inlet and a second lubricant outlet, the second lubricant passage being configured to provide lubricant to the third bearing. The second gate rotor shaft may extend longitudinally downwardly from the second gate rotor support. The second bearing assembly may be the only bearing assembly by which the second gate rotor is rotationally mounted within the second gate rotor chamber of the compressor housing. The second gate rotor shaft may have a second length that extends from the second gate rotor support downwardly to a second gate rotor shaft base, and the first portion of the second gate rotor shaft that is surrounded by the third bearing may be located on an upper half of the second length of the second gate rotor shaft. The second bearing assembly may further comprise a second seal located above the third bearing, the second seal being configured to prevent lubricant from entering the second gate rotor chamber. The second bearing assembly may further include a fourth bearing that surrounds a second portion of the second gate rotor shaft, and the second lubricant passage may be configured to provide lubricant to both the third bearing and the fourth bearing. The second portion of the second gate rotor shaft that is surrounded by the fourth bearing may be located on a lower half of the second length of the second gate rotor shaft. The second lubricant inlet may be located below the second bearing. The second lubricant outlet may be located below the second lubricant inlet and lubricant injected into the second lubricant passage through the second lubricant inlet may flow by gravity downwardly through the second lubricant passage to the second lubricant outlet.

In accordance with the discussion of the illustrated embodiments above, it should also be understood that methods of assembling and operating a screw compressor of the preset technology are provided, wherein the screw compressor includes: a compressor housing that defines a cylindrical bore and a first gate rotor chamber; and a main rotor rotationally mounted within the cylindrical bore of the compressor housing, the main rotor including at least one helical groove that defines a compression chamber. Such methods may include rotationally mounting a first gate rotor within the first gate rotor chamber of the compressor housing by a first bearing assembly; wherein the first gate rotor includes a first gate rotor blade secured to a first gate rotor support and has a first gate rotor shaft that extends longitudinally in a single direction from the first gate rotor support, and the first bearing assembly includes a first bearing trat surrounds a first portion of the gate rotor shaft, a first lubricant passage having a first lubricant inlet and a first lubricant outlet, the first lubricant passage being configured to provide lubricant to the first bearing. The rotationally mounting of such method may include inserting a portion of the first gate rotor shaft into the first bearing assembly and rotationally mounting the first gate rotor shaft within the first bearing assembly. The rotationally mounting of such method may also include securing the first bearing assembly to the compressor housing. Methods of methods of assembling and operating a screw compressor of the preset technology may also include: injecting lubricant into the first lubricant inlet during operation of the screw compressor; allowing the lubricant to flow by gravity through the first lubricant passage; and collecting lubricant that exits the first lubricant passage through the first lubricant outlet.

From the foregoing, it will be appreciated that although specific examples have been described herein for purposes of illustration, various modifications can be made without deviating from the spirit or scope of this disclosure. It is therefore intended that the foregoing detailed description be regarded as illustrative rather than limiting, and that it be understood that it is the following claims, including all equivalents, that are intended to particularly point out and distinctly claim the claimed subject matter.

What is claimed is:

1. A screw compressor comprising:

a compressor housing that defines a cylindrical bore and a first gate rotor chamber;

a main rotor rotationally mounted within the cylindrical bore of the compressor housing, the main rotor including at least one helical groove that defines a compression chamber; and a first gate rotor rotationally mounted within the first gate rotor chamber of the compressor housing by a first bearing assembly, the first gate rotor including a first gate rotor blade secured to a first gate rotor support and having a first gate rotor shaft that extends longitudinally in a single direction from the first gate rotor support;

wherein the first gate rotor shaft extends into and is rotationally mounted within the first bearing assembly, and the first bearing assembly includes a first bearing that surrounds a first portion of the gate rotor shaft, a first lubricant passage having a first lubricant inlet and a first lubricant outlet, the first lubricant passage being configured to provide lubricant to the first bearing, wherein the first bearing assembly further comprises a first seal located above the first bearing, the first seal being configured to prevent lubricant from entering the first gate rotor chamber.

2. The screw compressor of claim 1, wherein the first gate rotor shaft extends longitudinally downwardly from the first gate rotor support.

3. The screw compressor of claim 1, wherein the first bearing assembly is the only bearing assembly by which the first gate rotor is rotationally mounted within the first gate rotor chamber of the compressor housing.

4. The screw compressor of claim 1, wherein the first gate rotor shaft has a first length that extends from the first gate rotor support downwardly to a first gate rotor shaft base, and the first portion of the first gate rotor shaft that is surrounded by the first bearing is located on an upper half of the first length of the first gate rotor shaft.

5. The screw compressor of claim 1, wherein the first bearing assembly further includes a second bearing that surrounds a second portion of the first gate rotor shaft, and the first lubricant passage is configured to provide lubricant to both the first bearing and the second bearing.

6. The screw compressor of claim 5, wherein the second portion of the first gate rotor shaft that is surrounded by the second bearing is located on a lower half of the first length of the first gate rotor shaft.

7. The screw compressor of claim 5, wherein the first lubricant inlet is located below the first bearing.

8. The screw compressor of claim 1, wherein the first lubricant outlet is located below the first lubricant inlet and lubricant injected into the first lubricant passage through the first lubricant inlet flows by gravity downwardly through the first lubricant passage to the first lubricant outlet.

9. The screw compressor of claim 1, wherein the compressor housing further defines a second gate rotor chamber, and the screw compressor further comprises:

a second gate rotor rotationally mounted within the second gate rotor chamber of the compressor housing by a second bearing assembly, the second gate rotor including a second gate rotor blade secured to secured to a second gate rotor support and having a second gate rotor shaft that extends longitudinally in a single direction from the second gate rotor support;

wherein the second gate rotor shaft extends into and is rotationally mounted within the second bearing assembly, and the second bearing assembly includes a third bearing that surrounds a first portion of the second gate rotor shaft, a second lubricant passage having a second lubricant inlet and a second lubricant outlet, the second lubricant passage being configured to provide lubricant to the third bearing.

10. The screw compressor of claim 9, wherein the second gate rotor shaft extends longitudinally downwardly from the second gate rotor support.

11. The screw compressor of claim 9, wherein the second bearing assembly is the only bearing assembly by which the second gate rotor is rotationally mounted within the second gate rotor chamber of the compressor housing.

12. The screw compressor of claim 9, wherein the second gate rotor shaft has a second length that extends from the second gate rotor support downwardly to a second gate rotor shaft base, and the first portion of the second gate rotor shaft that is surrounded by the third bearing is located on an upper half of the second length of the second gate rotor shaft.

13. The screw compressor of claim 12, wherein the second bearing assembly further comprises a second seal located above the third bearing, the second seal being configured to prevent lubricant from entering the second gate rotor chamber.

14. The screw compressor of claim 9, wherein the second bearing assembly further includes a fourth bearing that surrounds a second portion of the second gate rotor shaft, and the second lubricant passage is configured to provide lubricant to both the third bearing and the fourth bearing.

15. The screw compressor of claim 14, wherein the second portion of the second gate rotor shaft that is surrounded by the fourth bearing is located on a lower half of the second length of the second gate rotor shaft.

16. The screw compressor of claim 5, wherein the second lubricant inlet is located below the second bearing.

17. The screw compressor of claim 9, wherein the second lubricant outlet is located below the second lubricant inlet and lubricant injected into the second lubricant passage through the second lubricant inlet flows by gravity downwardly through the second lubricant passage to the second lubricant outlet.

18. A method of assembling and operating a screw compressor, wherein the screw compressor includes: a compressor housing that defines a cylindrical bore and a first gate rotor chamber; and a main rotor rotationally mounted within the cylindrical bore of the compressor housing, the main rotor including at least one helical groove that defines a compression chamber, the method comprising:

rotationally mounting a first gate rotor within the first gate rotor chamber of the compressor housing by a first bearing assembly;

wherein the first gate rotor includes a first gate rotor blade secured to a first gate rotor support and has a first gate rotor shaft that extends longitudinally in a single direction from the first gate rotor support, and the first bearing assembly includes a first bearing that surrounds a first portion of the gate rotor shaft, a first lubricant passage having a first lubricant inlet and a first lubricant outlet, the first lubricant passage being configured to provide lubricant to the first bearing;

wherein the rotationally mounting includes:

inserting a portion of the first gate rotor shaft into the first bearing assembly and rotationally mounting the first gate rotor shaft within the first bearing assembly; and securing the first bearing assembly to the compressor housing, wherein the first bearing assembly further comprises a first seal located above the first bearing, the first seal being configured to prevent lubricant from entering the first gate rotor chamber.

19. The method of assembling and operating a screw compressor of claim 18, further comprising injecting lubricant into the first lubricant inlet during operation of the screw compressor;

allowing the lubricant to flow by gravity through the first lubricant passage; and collecting lubricant that exits the first lubricant passage through the first lubricant outlet.

* * * * *